US005343121A

United States Patent [19]

Terman et al.

[11] Patent Number: 5,343,121

[45] Date of Patent: Aug. 30, 1994

[54] NATURALISTIC ILLUMINATION SYSTEM

[76] Inventors: Michael Terman, 14 E. Fourth St., New York, N.Y. 10003; Bill Perlman, 865 W. End Ave. 10025, New York, N.Y. 10025; Stephen Fairhurst, 230 Riverside Dr., New York, N.Y. 10032

[21] Appl. No.: 526,784

[22] Filed: May 22, 1990

Related U.S. Application Data

[63] Continuation of Ser. No. 250,967, Sep. 23, 1988, abandoned, which is a continuation of Ser. No. 916,872, Oct. 9, 1986, abandoned.

[51] Int. Cl.[5] ..... H05B 37/02

[52] U.S. Cl. ..... 315/158; 315/307; 315/160

[58] Field of Search ..... 315/158, 157, 159, 160, 315/155, 151, 156, 307, 149, 194, 291, 360; 250/200-204

[56] References Cited

U.S. PATENT DOCUMENTS

| | | | |
|---|---|---|---|
| Re. 32,450 | 6/1987 | Blake | 315/158 |
| 3,531,684 | 9/1970 | Nuckolls | 315/158 |
| 3,989,980 | 11/1976 | Berman | 315/158 |
| 4,135,116 | 1/1979 | Smith | 315/149 |
| 4,190,795 | 2/1980 | Schultheis | 315/158 |
| 4,273,999 | 6/1981 | Pierpoint | 315/158 |
| 4,281,365 | 7/1981 | Elving et al. | 315/158 |
| 4,347,461 | 8/1982 | Carlson | 315/158 |
| 4,467,246 | 8/1984 | Tanaka et al. | 315/158 |
| 4,575,659 | 3/1986 | Pezzolo | 315/360 |
| 4,587,459 | 5/1986 | Blake | 315/158 |
| 4,697,122 | 9/1987 | Hoffer | 315/158 |
| 4,701,669 | 10/1987 | Head | 315/151 |

OTHER PUBLICATIONS

Graham, Behavior Research Methods & Inst., 1977, vol. 9(4). 395-396.

*Primary Examiner*—Eugene R. LaRoche
*Assistant Examiner*—A. Zarabian
*Attorney, Agent, or Firm*—Darby & Darby

[57] ABSTRACT

Apparatus for adjusting the circadian rhythm of a subject in a space by producing a variable light intensity level on a continuous basis in which there is a light source and the light output from the source made available to the subject in the space is controlled in response to a control signal which varies in a manner corresponding to the solar and lunar altitude of a predetermined geographical location and the passage of time over a selected time interval of the day at predetermined geographical location.

23 Claims, 12 Drawing Sheets

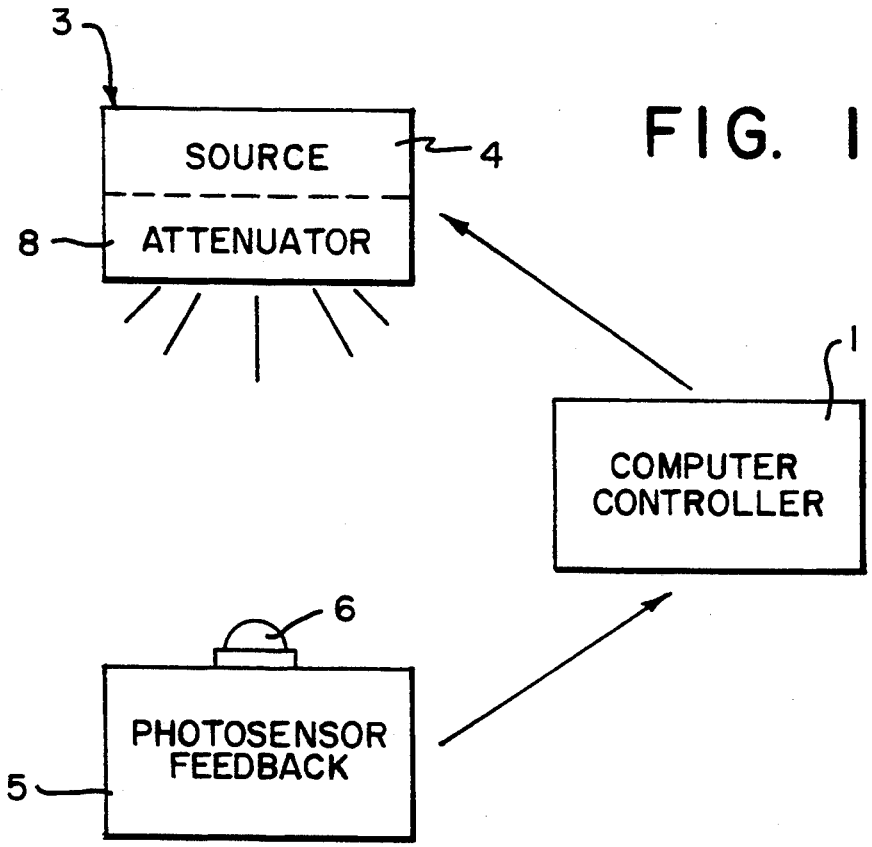
FIG. 1
FIG. 2
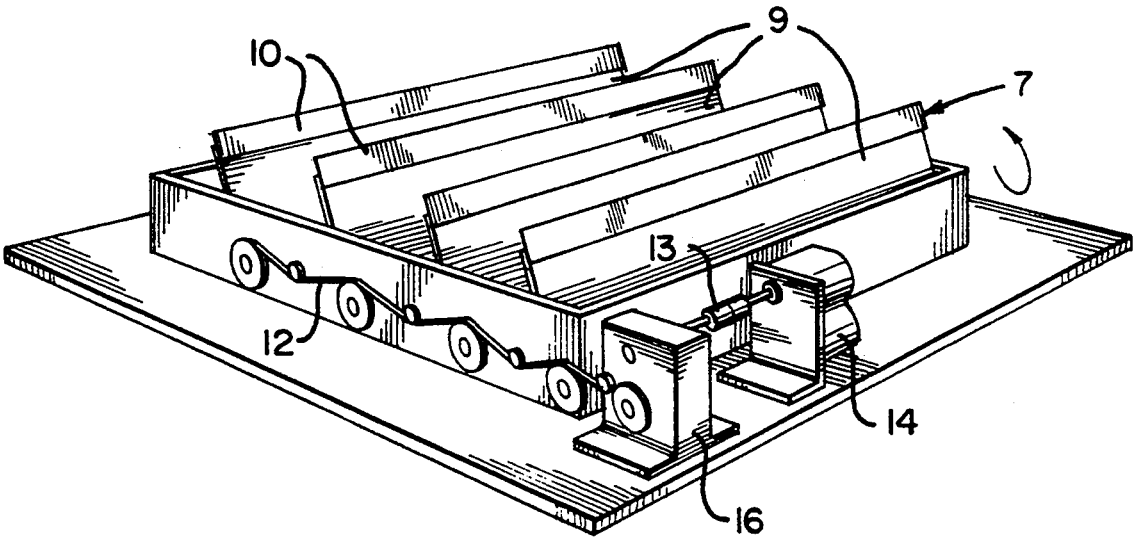

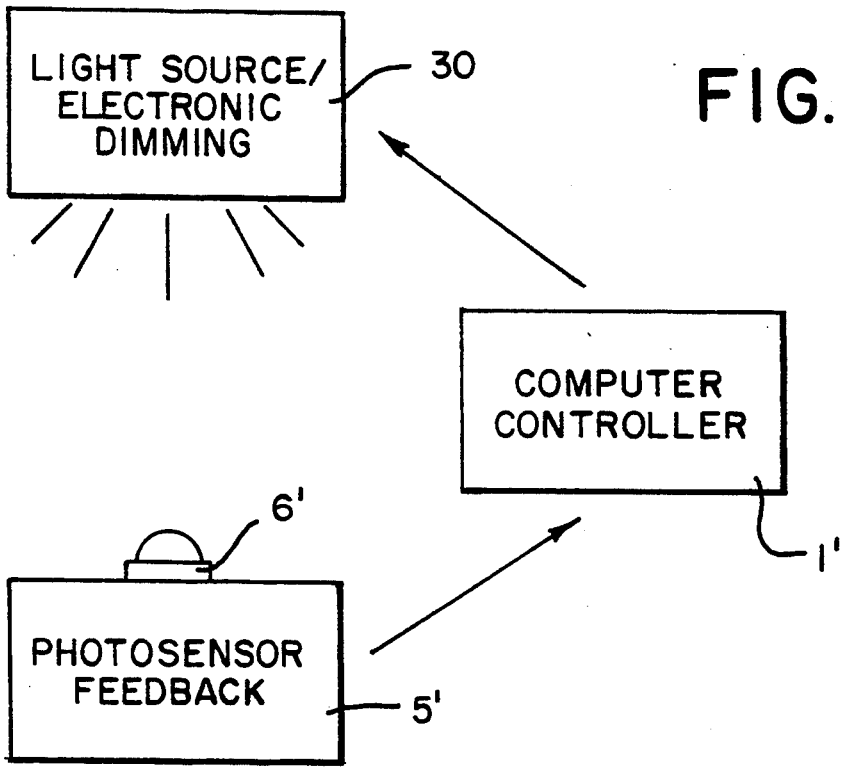
FIG. 3
FIG. 5
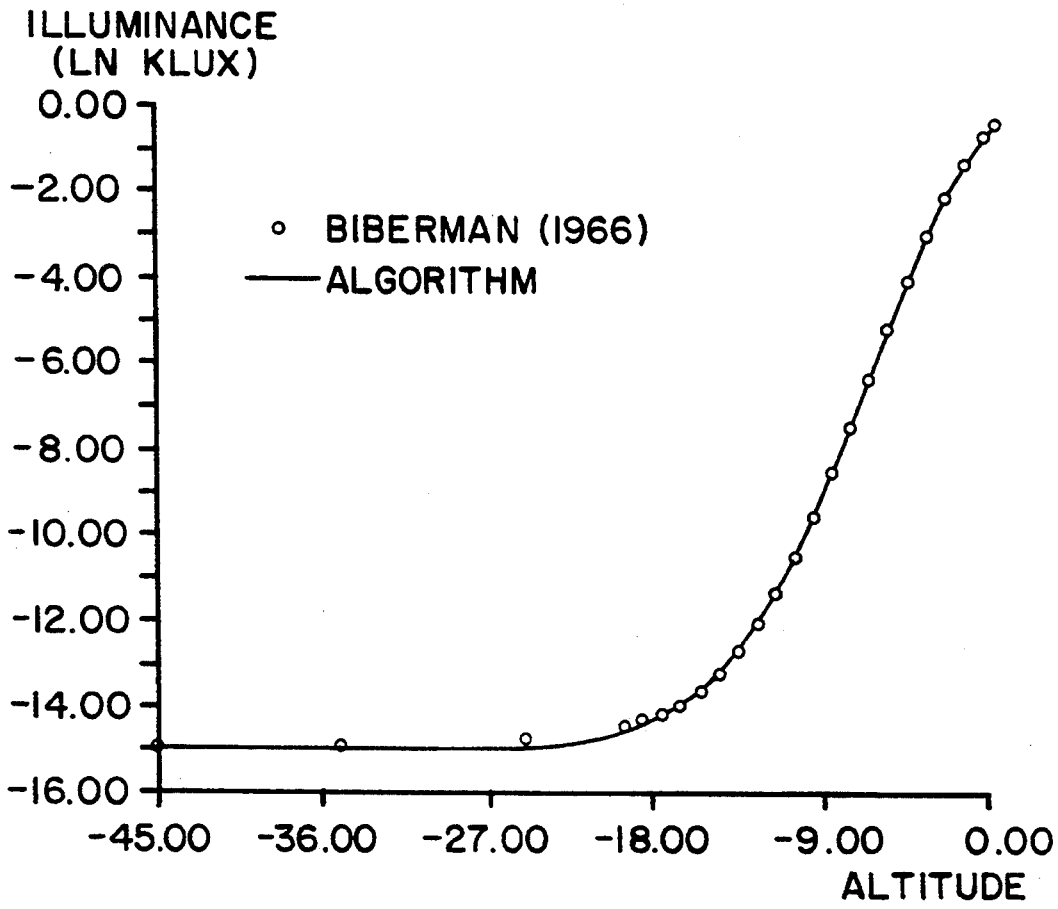

NATURALISTIC ILLUMINATION SYSTEM

This is a continuation of application Ser. No. 250,967, filed Sep. 23, 1988, abandoned, which is a continuation of Ser. No. 916,872, filed Oct. 9, 1986, abandoned.

BACKGROUND OF THE INVENTION

The invention pertains to a system for providing naturalistic illumination patterns. More particularly, the invention pertains to a system for providing gradual interior illumination changes that accurately mimic light transitions of the natural world.

Human and other animal species live under conditions of natural illumination, both indoors and outdoors. Solar, lunar, and skylight illumination, it is believed, provide an environmental fabric that serves as a guiding force for performance, physiology, psychology and mood. Through research, scientists have been able to learn a great deal about the rhythmic nature of bodily systems and their interaction with illumination patterns.

It is submitted that artificial indoor lighting regimens—epitomized by somewhat arbitrary electric lighting in windowless rooms—pose undue and severe challenges to the occupant, being likely to adversely affect the natural rhythms that influence human behavior. The problem has already become apparent in many non-human laboratory studies. The daily ingestive pattern of nocturnal rodents, for example, is substantially modified by the absence or presence of cyclic lighting (Terman, Behavioral Analysis and Circadian Rythms, In: *Advances in Analysis Behavior,* Chichester: Wiley, pp. 103–141 (1983)). Researchers at the National Marine Fisheries Laboratory, Department of Commerce, have observed that sudden transitions from darkness to bright light induce the behavioral equivalent of "panic" in the bluefish, and for this reason have specified gradual twilights for their aquarium (Olla, et al, A Large Experimental Aquarium System for Marine Pelagic Fishes, *Transactions of the American Fisheries Society* 96:143–150 (1967)).

Physiological events during gradual twilights may be active transducers of day-night synchronizing signals, and in outdoor field studies it is common to find species selectively activated at dawn and dusk hours (e.g., Kavanau, et al, Twilight Zeitgebers, Weather, and Activity of Nocturnal Primates, *Folia Primatologia* 26:67–79 (1976)). Given the opportunity—which is absent in tightly controlled, spatially isolated laboratory studies—many species appear actively to "seek" the twilight signal, and to avoid tonic exposure to high daytime illumination levels. For example, given an escape option, through use of an artificial darkened burrow, the nocturnal rat selects bright light only briefly each day, and actually receives more light during a dim nighttime phase (Lynch, et al, Indirect Effects of Light: Ecological and Ethological Considerations, *Annals of the New York Academy of Sciences* 453:231–241 (1985)).

Twilight illumination is believed to be especially critical. For example, the human retina itself appears to respond selectively to twilights. It is known that photoreceptive discs in the rod outer segments of many species "shed" in a temporal burst, and are digested by the pigment epithelium shortly after light onset each day under the sudden illumination transitions of the laboratory (LaVail, Rod Outer Segment Disk Shedding in Rat Retina: Relationship to Cyclic Lighting, *Science* 194:1071–1074 (1976)). Under constant darkness, the circadian distribution of such shedding is considerably more diffuse. The normal photoreceptor renewal process may well depend on synchronization by natural daylight signals and it is believed possible that conventional indoor light cycling may pose a hazard to retinal physiology. A recent demonstration of severe retinopathy in hospitalized premature infants under protracted artificial light (Glass, et al, Effect of Bright Light in the Hospital Nursery on the Incidence of Retinopathy of Prematurity, *The New England Journal of Medicine* 313: 401–404 (1985)) reinforces this concern.

The lighting arbitrariness of the laboratory finds analogues in everyday urban life, where general daylight deprivation as well as deviant and variable light-switching schedules are common. Recent research has clearly documented human sensitivity to ambient illumination factors, as exemplified in winter at northern latitudes where daylight is insufficient to forestall clinical depressions, sleeping disturbances, and work productivity disruptions (e.g., Rosenthal, et al, Seasonal Affective Disorder: A Description of the Syndrome and Preliminary Findings with Light Therapy, *Archives of General Psychiatry* 41:72–80 (1984)).

When buildings are designed, many competing needs must be taken into account. This is especially true in the design of lighting systems, where the needs of the people who live and work indoors have often been supplanted by other contingencies. The pressure toward energy conservation forces reductions in indoor light availability—sometimes even codified in industrial standards (Thorington, Spectral, Irradiance, and Temporal Aspects of Natural and Artificial Light, *Annals of the New York Academy of Sciences* 453:28–54 (1985)).

A great deal is now known about the quantity of light needed to perform a wide variety of visual tasks, as well as the quality of light, for example, in terms of glare. The Illumination Engineering Society of North America has codified this knowledge into a set of recommendations (Kaufman, et al., *IES Lighting Handbook* (1981)). Little is presently known, however, about the impact of temporal variations in illumination upon long-term human performance and productivity. Human health, comfort, and productivity may be enhanced under conditions that more closely simulate naturally available light (e.g., Corth, What is "Natural" Light?, *Lighting Design and Application,* April issue, 34–40 (1983)). The daylight spectrum can be fairly mimicked by both fluorescent and halogen lighting sources (e.g., Thorington, et al, *Journal of the Illumination Engineering Society* 1:33–41 (1971)) but the critical variable of naturalistic temporal variation has yet to be applied.

One well-known prior illumination technology is the use of windows. That link to outdoor illumination, providing both light and view, is thought to provide benefits both to health and comfort (e.g., Ulrich, View Through a Window May Influence Recovery from Surgery, *Science* 224:421 (1984)); Verderber, *Windows and Well-Being in the Hospital Rehabilitation Environment,* Arch. D. dissertation, Ann Arbor: University Microfilms (1982)). Worker discontent with windowless office spaces is well-known (Collins, Windows and People: a Literature Survey, Building Science Series 70, Washington, D.C.: National Bureau of Standards (1975)). The current development of major U.S. government and industrial earth-sheltered environments, in which people will live and work for extended periods exclusively under indoor lighting, underscores the importance of this problem.

Previous work on daylight simulation problems concentrated almost exclusively on the daytime segment with the solar disk fully exposed above the horizon (e.g., Treado, Solar Radiation and Illumination, National Bureau of Standards Technical Note #1148 (1981)). The twilight factor has been explored in a complex treatise by the Russian astronomer Rozenberg, *Twilight: A Study in Atmospheric Optics*, New York: Plenum Press, (Trans. from Russian)(1966), and an empirical generalization of the twilight signal as a function of the sun's angular distance below the horizon was included in Biberman, *Levels of Nocturnal Illumination*, Research Paper P-232, Institute for Defense Analysis, Research and Engineering Support Division (1966).

Previous attempts have been made to build naturalistic simulators of daily illumination patterns. The various output functions that have been produced from known systems have all differed arbitrarily from the outdoor situation. Several workers in this field have varied voltage to incandescent lamps, yielding both arbitrary dimming cycles and idiosyncratic spectral shifts (e.g., Graham, et al, A Device for Simulating Twilight in Studies of Animal Activity, *Behavior Research Methods and Instrumentation* 9:395 (1977); Allen, A Device Providing Gradual Transitions Between Light and Dark Periods in the Animal Room, *Laboratory Animal Science* 12:252–254 (1980)). A second design turns a large bank of fluorescent lamps on and off in discrete steps, eliminating the spectral shift, yet failing to match the desired temporal transition curve. Swade, et al, in Circadian Locomotor Rhythms of Rodents in the Arctic, *The American Naturalist* 101:341–464 (1967) used a rotating aluminum channel to gradually cover and uncover a fluorescent bulb, and Kavaliers, et al, in Twilight and Day Length Affect the Seasonality of Entrainment and Endogenous Circadian Rhythms of a Fish, *Couesius plumbieus, Canadian Journal of Psychology* 59:1326–1334 (1980) developed an elaborate system of motor-pulley driven filters to obtain a log-linear illumination transition. One well-known prior illumination system, the whole-room illuminator at the National Fisheries Lab, uses an extensive bank of bulbs which turn on and off in a stepping pattern. The National Fisheries Lab system requires much effort to maintain, and a more efficient alternative is greatly needed.

No known prior design has produced an adequately naturalistic illumination function with the ability to track the season and latitude. No known prior system has been able to control light levels below the civil twilight range, the latter being quite bright relative to nautical and astronomical light levels that are orders of magnitude lower, yet still quite easily perceptible. The lunar illumination factor has also not previously been successfully modeled, although it too may provide a potent biological signal. Further, previous work has not offered a satisfactory engineering design for use in either laboratories or in human living and working environments.

It is therefore an object of the invention to provide a twenty-four hour naturalistic illumination system for use in illuminating interior environments.

It is a further object of the invention to provide a naturalistic illumination system for determining expected outdoor illumination levels across seasons and latitudes.

It is a further object of the invention to provide a naturalistic illumination system for providing natural light changes within living, working and laboratory environments.

SUMMARY OF THE INVENTION

These and other objects of the invention are met by providing a naturalistic illumination system comprising a light source, a light-attenuation mechanism, a computer controller, and a photosensor feedback loop. The light attenuation mechanism in one embodiment comprises a set of precision mechanical vanes which are closed and opened gradually by a silent motor drive. In another embodiment, an electronic dimming system for indirect lighting may be provided. A comprehensive reference generating algorithm specifies the expected momentary level of illumination on the earth's surface—from skylight, sunlight, and moonlight sources—across a twenty-four hour day, at any day of the year and geographic latitude. By means of precision motor-control interface, the algorithm drives the light-attenuation mechanism, thereby producing simulated naturalistic illumination patterns. A photosensor at the target surface measures the light received and sends the empirical reading to the computer, which adjusts the illumination level dynamically for an optimal fit to the algorithm specifications.

A wide range of applications is provided by the invention in research situations, as well as in home, workplace, hospital, industry, and military installations.

BRIEF DESCRIPTION OF THE DRAWINGS

The invention will be described in greater detail below by way of reference to the following drawings, in which:

FIG. 1 is a block diagram illustrating one embodiment of the invention including a light box;

FIG. 2 is a perspective view of a shutter mechanism for light attenuation in one embodiment of the invention;

FIG. 3 is a block diagram of a second embodiment of the invention including an electronic dimming system;

FIG. 5 is a graphic representation comparing empirically observed twilight factors and twilight factors generated by one embodiment of the invention;

DETAILED DESCRIPTION OF THE DRAWINGS

Figure 4A:
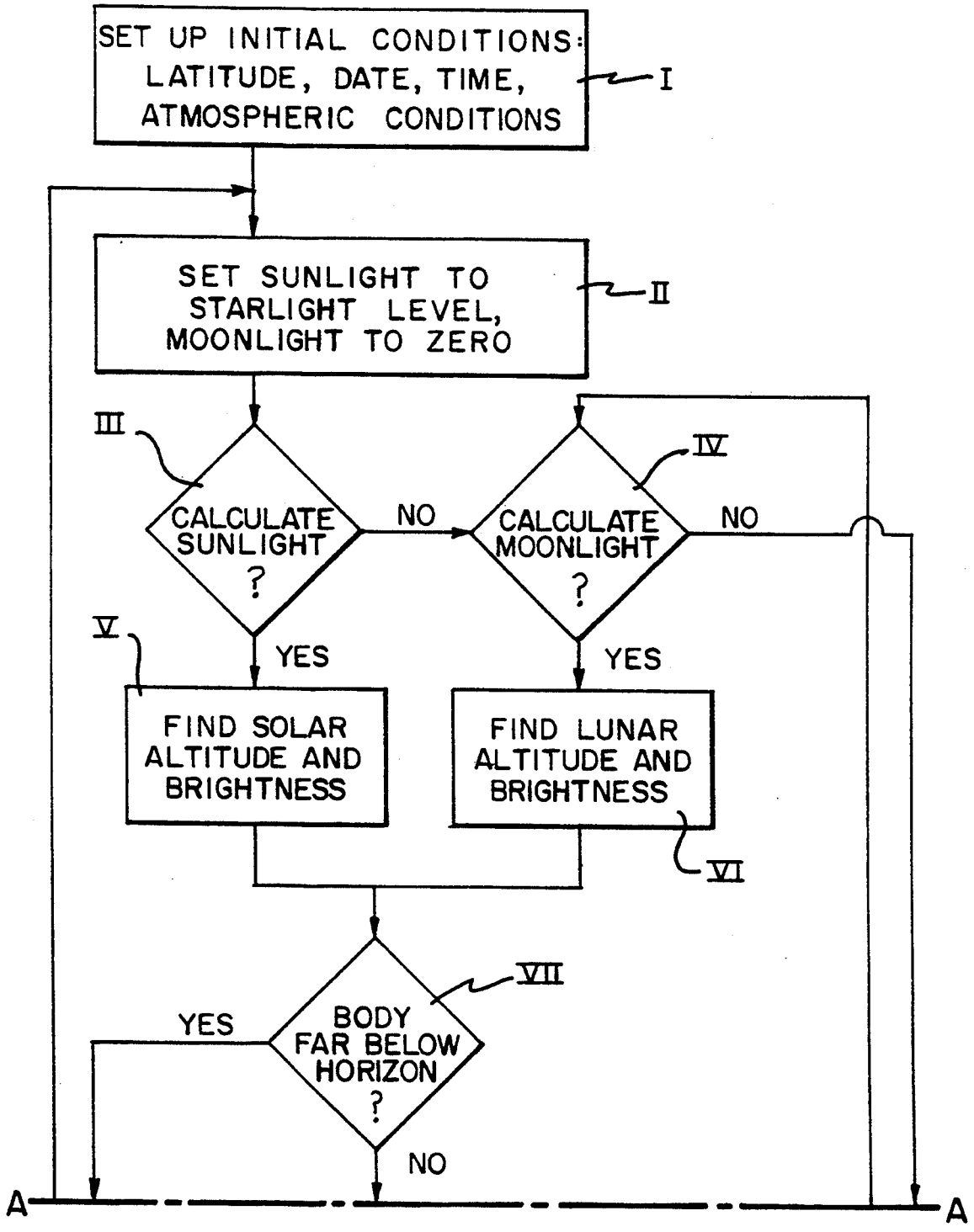
FIGS. 4A and 4B are a flow chart illustrating general operating functions of one embodiment of a driving algorithm according to the invention.

The invention provides gradual interior illumination changes that accurately mimic dawn and dusk twilights of the external world, as well as the lunar component and low daylight levels, at any time of year and at any geographical location. A first embodiment of the invention will now be described by way of reference to FIG. 1. The embodiment of FIG. 1 includes three functional, interacting components: a computer controller 1, a light box 3 and a photosensor feedback unit 5.

The light box 3 is designed to present continuously graded illumination from darkness to low-sunlight levels (for example, approximately 3 klux). In the embodiment of FIG. 1, the light box 3 includes a constant light source 4 and an attenuator 8. The output of light box 3 is governed by a reference generating computer program, resident in the controller unit 1, that calculates momentary illumination levels. The light source may include, for example a bank of eight daylight-spectrum 20 watt fluorescent lamps mounted in a modular unit similar to that used for phototherapy of hyperbilirubinimia in hospital neonatal intensive care units. In other embodiments, greater intensity light sources may be provided to light larger spaces.

In operation, an illuminance photosensor 6 of feedback unit 5 measures the actual light output received at the target surface. This information is provided to the computer controller 1 which then triggers fine adjustments to the light box 3 for an accurate match to algorithm specifications. The function and operation of the reference generating program will be discussed below by way of reference to FIG. 4.

A light attenuation mechanism 7, of the type illustrated in FIG. 2, may be secured to the light source 4 within light box 3 of FIG. 1. The light attenuation mechanism 7 of FIG. 2 is shown having four adjustable vanes 9 each of which includes a flat light guard 10 for providing an opaquing function. The vanes 9 rotate in unison in the direction of the arrow to reduce light transmission and in the opposite direction to increase light transmission.

The vanes 9, are intended to provide an opaque block when fully closed and, in the embodiment of FIG. 2, are preferably precision-machined and gear-driven. The vanes 9, may be tight-fitted beneath the lamps of the light source 4. In the embodiment of FIG. 2, the vanes are opened and closed gradually by means of a precision gear train 12 driven by a motor drive 14 such as silent 12 volt d.c. motor connected to a gearbox 16 through a universal coupling 13. The gear ratio may be set such that the full excursion of the vanes (from 0 degrees at minimum transmission, to 90 degrees at maximum transmission) requires 38,400 steps. This gear ratio provides approximately 0.0023° resolution (i.e., 90°/38400 steps) which allows a great degree of control and delivery of an essentially continuous signal.

Alternatively, the attenuator may provide a DC servo drive with an encoder to indicate position rather than a stepper motor. With tachometer feedback, the DC servo would allow for control of rate of change of illuminance as well as discrete illuminance values. Other embodiments may provide cam or linkage systems for driving the mechanical vanes 9.

The embodiment of FIG. 3 is similar to that of FIG. 1 but includes a variable light source 30 having an electronic dimming function as an illuminator. This embodiment eliminates the need for the light attenuating shutter mechanism 7 of FIG. 2. The electronic dimming source 30 of FIG. 3 would, however, operate similarly to the light box of FIG. 1 in that both would receive signals from the computer controller 1, 1' directing the illumination level and each would provide variable output.

The general functions of an example reference generating algorithm for generating momentary, naturalistic light reference levels in accordance with one embodiment of the invention will be discussed by way of reference to the flow chart of FIG. 4.

Figure 4B:
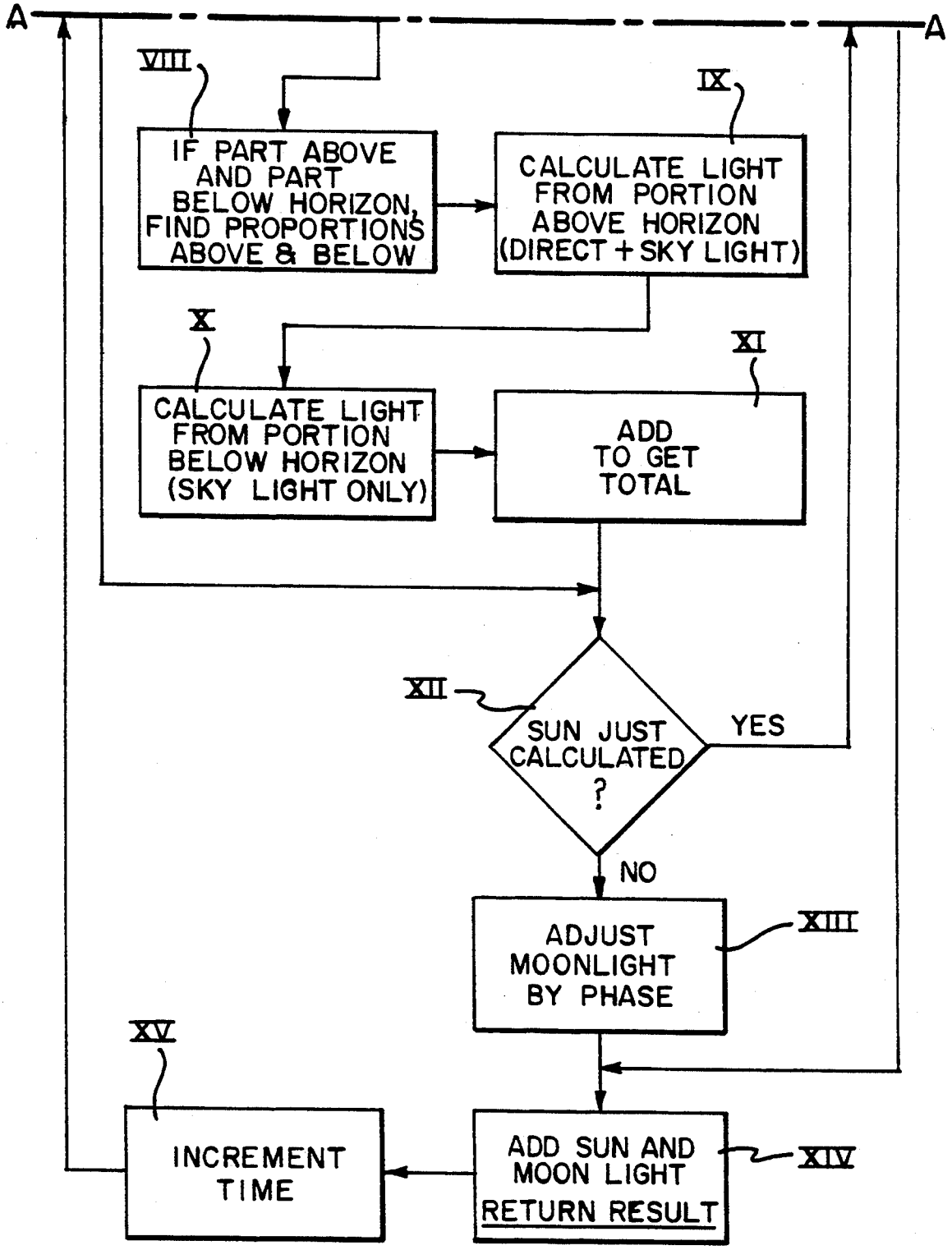
Figure 6A:
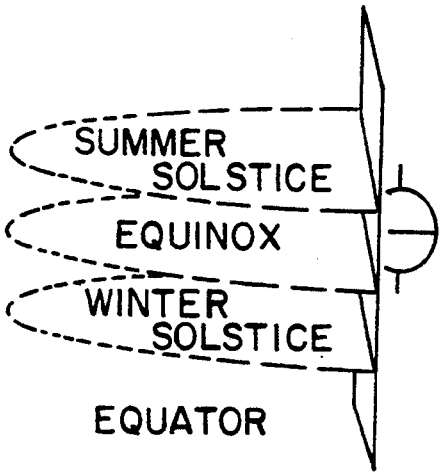
FIGS. 6A–6E illustrate various earth-sun-horizon relationships according to season.
Figure 6B:
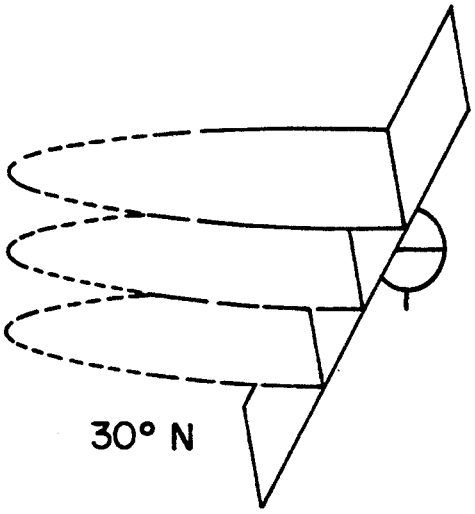
Figure 6C:
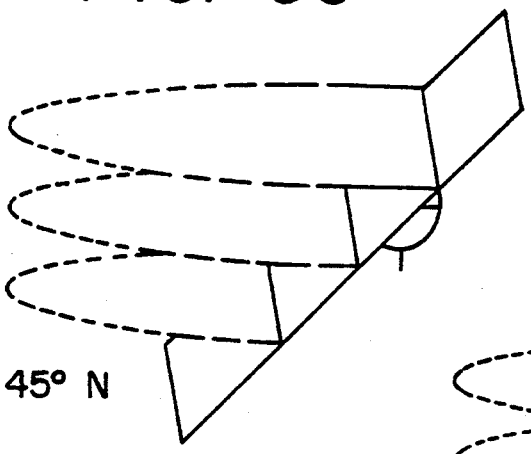
Figure 6D:
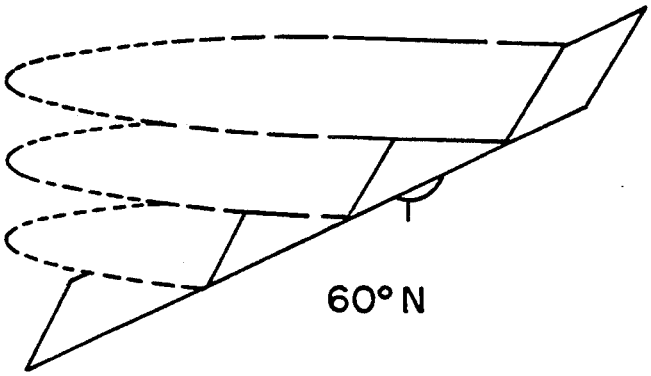
Figure 6E:
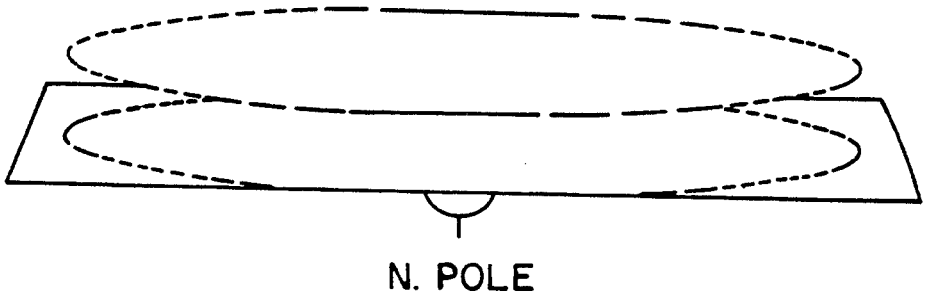

In the algorithm of FIG. 4, initial conditions such as latitude, date, time and atmospheric conditions are provided as variables (Step I). Initial values for the variables may be provided by a user. As a further initialization, sunlight is set to a starlight level and moonlight is set equal to zero (Step II). The algorithm may also allow the user to specify whether sunlight is to be calculated or whether it is to be ignored leaving only moonlight to be calculated (Step III). If sunlight level is to be calculated, solar altitude and brightness are then computed (Step V). The algorithm preferably will always take solar position into account, even if sunlight is not to be calculated, since solar position 13 is necessary for accurately calculating moonlight.

The algorithm may also allow the user to specify whether moonlight levels should be calculated (Step IV). If so, lunar altitude and brightness are then calculated (Step VI). If neither sunlight nor moonlight are to be calculated, the starlight level of sunlight and zero level of moonlight are summed and the sum is returned as the result of the algorithm (Step XIV). If both sunlight and moonlight are to be calculated, then solar altitude and brightness (Step V) and lunar altitude and brightness (Step VI) are both calculated.

In the case where either sunlight or moonlight is to be calculated, the algorithm first determines, from the latitude, date and time variables, whether the solar or lunar body is located far below the horizon (Step VII). If the initial position calculations for the sun show that the sun is so far below the horizon that it will provide no light, the "sunlight" will be left at starlight level. Similarly, if the initial lunar position indicates that no light will be provided, "moonlight" will be left at zero.

If the solar body is not far below the horizon, the algorithm then determines whether part of the body is above the horizon while part of it is below the horizon. If part is above and part is below, the algorithm then computes the relative proportions of the solar body above and below the horizon (Step VIII). Skylight intensity is then computed from the portion above the horizon by calculating both direct light plus skylight (Step IX). The skylight from the portion below the horizon is also calculated (Step X) and added the light from the portion above the horizon to get a total illumination (Step XI).

The algorithm then checks to see whether sunlight illumination has just been calculated (Step XII) and, if so, the procedure is repeated for moonlight levels, including calculating the moonlight levels from the proportion of the lunar disc above and below the horizon, if appropriate (Steps VII–XI). After the moonlight levels are calculated, moonlight levels may be adjusted according to the phase of the moon, the latter being determined by the date and time (Step XIII). The sunlight and moonlight levels are then summed and the total illumination level is returned as the result of the algorithm. (Step XIV). The time of day may then be incremented (Step XV) and the algorithm repeated for successive momentary increments.

Figure 10:
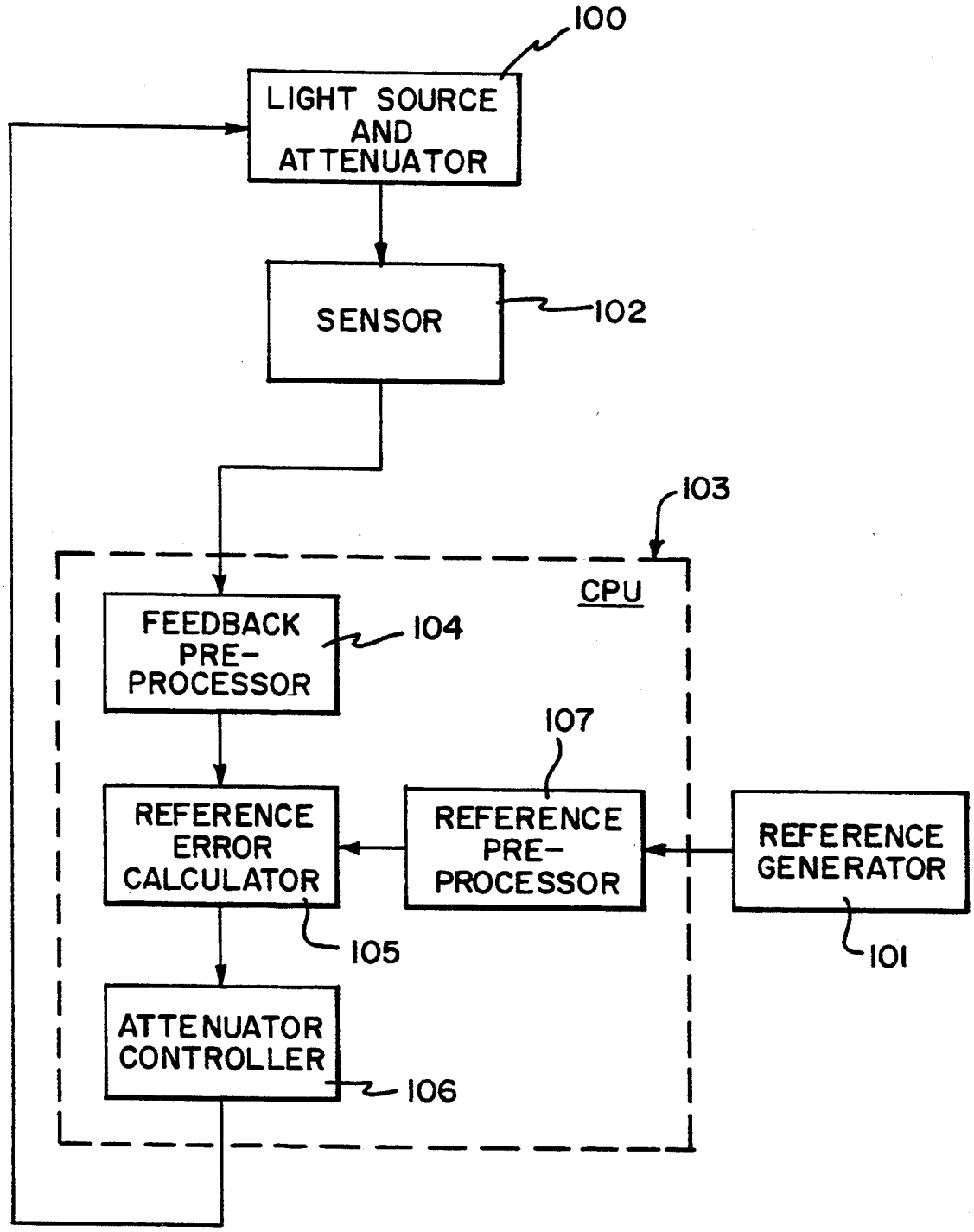
FIG. 10 is a block diagram of one embodiment of the invention illustrating the generation of light level references.

Before describing a detailed embodiment of the procedures outlined in FIG. 4, the function of a reference generating algorithm of the type described in FIG. 4, within an embodiment according to the invention will be discussed with reference to the block diagram of FIG. 10. In FIG. 10, an algorithm according to FIG. 4 may be embodied within a reference generator 101 for generating momentary expected light level for a given latitude at a particular time. These values may then be output to a reference pre-processor 107 within a control unit 103 for pre-processing the output into a form usable by the control unit.

The control unit 103 also receives an input from a photosensor 102 which indicates the actual momentary lighting presumably generated from the light source and attenuator unit 100. The photosensor output is likewise placed in processable form within control unit 103 by a feedback pre-processor 104 For example, an analog signal from sensor 102 may be digitized at the feedback pre-processor 104.

The pre-processed actual momentary illumination level detected by feedback from photosensor 102 is compared with the pre-processed expected momentary level from reference generator 101 and an error therebetween is calculated at reference error calculator 105 within control unit 103. The calculated error is then provided as an input to the attenuation controller 106 which adjusts the attenuating mechanism of the light source and attenuator unit 100 to provide more or less light in accordance with the detected error. Thus, the light source and attenuator unit 100 is directed to output light levels in accordance with predicted momentary naturalistic levels.

Returning to the algorithm of FIG. 4, specific embodiments of the various processes thereof will now be described in greater detail. It should be noted however that a wide variety of control algorithms and methodologies may be implemented within the scope of the invention.

The main objective of a reference generating algorithm such as that described in FIG. 4, is to find the amount of light falling on a horizontal surface of the earth (e.g. the ground) at any given place and time. For the purpose of the invention, it can be assumed that total light consists of sunlight, moonlight and starlight.

The starlight baseline illuminance may be expressed by the known constant[1],

[1]Data Sources: Brown, D. E. (1952) *Natural Illumination Charts,* Report #374-1, Buships, Dept. of the Navy, reprinted in Biberman, L. M. Dunkleman, L., Fickett, M. L., & Fincke, R. G. (1966) *Levels of Nocturnal Illumination* Research Paper p-232, Institute for Defense Analysis, Research and Engineering Support Division.

$$E_b = 3.014 * 10^{-7} \text{ Klux} \quad (1)$$

Sunlight and moonlight are each assumed to consist of two components, the direct light reaching the horizontal surface from the body $E_{dh}$, and the light from the body reaching the horizontal surface from the general lighting up of the sky $E_{kh}$. These two components in turn depend on the total amount of light reaching the planet from the illuminating body $E_{xt}$, the position of the body relative to the observer—particularly on the altitude ("a"), the angular distance from the horizon, atmospheric conditions, and the amount of air the light must penetrate to reach the observer $m_a$.

Given the day and time, the positions of the sun and moon relative to the earth, and the amount of light reaching the planet from each source, may be calculated. For sunlight, the variation in $E_{xt}$ depends on the varying distance between the earth and sun. For moonlight, the major variation in $E_{xt}$ is the variation in the phase of the moon.

Given the observer's latitude $L_e$ and longitude $G_e$, the altitude a and the air mass $m_a$ through which the light passes may be determined for each illuminating body.

For a given state of the atmosphere (e.g., clear, partly cloudy, fully cloudy) a set of parameters, described in greater detail below, determine the intensity of light as it passes through a unit mass of air.

The calculation of the illumination functions $E_{dh}$ and $E_{kh}$ is preferably divided into three cases, depending on whether the illuminating body is (a) above the horizon, (b) below the horizon, or (c) partly above and partly below the horizon. In the first two cases, the body can be treated as a point source concentrated at the center of the illuminating body. In the last case, the illuminating body may be split into two separate point sources, one above and one below the horizon. These sources are assumed equal in brightness to the portions above and below the horizon, and are centered at the centers of gravity of the respective portions.

The moon may be treated initially for purposes of computation as if it were a second sun. Lunar light may then be reduced to lunar maximum levels, and corrected for lunar phase.

The earth-sun-moon system may be treated for purposes of the invention as if the earth were the stationary center of the system, with its axis upright. This is mathematically equivalent to the true situation (i.e., the earth rotates on a tilted axis and revolves around the sun while the moon revolves about the earth) and corresponds to phenomena as seen by an observer on the surface of the earth.

With the foregoing generalizations in mind, one example of a specific procedure for computing momentary light level is discussed in the following sections I–IX. In the discussion which follows, all angular measures are expressed in radians unless otherwise specified and all illuminance measures are expressed in Klux.

I. Atmospheric conditions. The invention may povide for a wide variety of atmospheric conditions. In the instant example, three types of air conditions are recognized: clear, partly cloudy, and fully cloudy. These atmospheric conditions give rise to four parameters that determine how much of the extra-terrestrial light reaches the ground. The parameters are x, the extinction coefficient, which describes how much light is absorbed by the air; $E_0$, the amount of sunlight when the sun is on the horizon; c, an illuminance coefficient; and p, an illuminance exponent. Based on empirical observations, the following values may be set for the respective parameters[2]:

[2]Data Sources: IES Calculation Procedures Committee, *Recommended Practice for the Calculation of Daylight Availability,* Journal of IES [Illuminating Engineering Society] July 1984. In practice, 0.732 may be supplied for $E_0$, in the clear sky case. See Brown (1952) supra, f.n. 1.

for clear sky, $x=0.21$, $E_0=0.8$, $c=15.5$, $p=0.5$;

for partly-cloudy sky, $x=0.8$, $E_0=0.3$, $c=45.$, $p=1.0$; and for fully cloudy sky, $x=1.0$, $E_0=0.3$, $c=21.$, $p=1.0$.

A logarithmic twilight spread is also calculated as:

$$E_t = \ln(E_0) - \ln(E_b) \quad (2)$$

where $E_b$ is the stellar baseline calculated in equation (1), above.

II. Time. The time kept on standard clocks and watches is Mean Solar Time, standardized for zones of about 15° longitude in width. Since the sun's orbit is elliptical, and its speed varies, while the earth rotates at a constant speed, the true noon-to-noon interval varies around the mean value of 24 hours. However, the position of the sun cannot feasibly be used as a basis of time measurement if the purpose is to find the sun's position at a given time. Thus, for calculating astronomical positions, a non-varying time measure must be provided. One such example is the Sidereal Time S, which is calculated from the angular distance (in radians) between the prime (Greenwich) meridian and a distant fixed star. Since the earth rotates at a constant speed, Sidereal Time advances at a constant rate.

To calculate Sidereal Time, local clock time is first converted into Greenwich Mean Time ("GMT") by adding or subtracting the difference between local mean time and GMT. For example, for Eastern Standard Time ("EST"), 5 hours are added to local clock time since EST is 5 hours earlier than GMT. Then, GMT is converted into Universal Time T, by converting it into the number of days and fractions of days past since 0 hrs on January 0 of the current year. Thus, noon GMT on January 1 is day 1.5, while 6:00 on February 1 is day 32.25. Then, Universal Time T is converted into local apparent Sidereal Time S, taking into account the observer's longitude, i.e. the angular distance from the prime meridian.

Since a year is not an integral number of days, but is approximately 365¼ days, the Sidereal Time S at the start of the year $S_0$, varies in a 4-year cycle. Years evenly divisible by 4 are leap years with 366 days, unless they are evenly divisible by 100, and not by 400. All other years have 365 days.

Thus[3], for years evenly divisible may the number 4, $S_0=1.7417883$ radians;

[3]Data Source: *Almanac for Computers*, 1984, Nautical Almanac Office, United States Naval Observatory.

if the remainder of the year divided by 4 is 1, $S_0=1.7373714$;

if the remainder is 2, $S_0=1.733205$; and if the remainder is 3, $S_0=1.7290387$.

The current Sidereal Time may then be calculated as:

$$S=S_0+6.3003881T-G_e \quad (3)$$

S must be less than 2pi and it is therefore expressed as modulus 2pi (i.e. reduce by as many integral multiples of 2 pi as it contains).

III. Solar Position[4]. The sun's position relative to the observer's horizon may be calculated starting with the sun's elliptical and tilted orbit. Thus, the mean anomoly at the start of the year $A_0$, and the longitude of perigee at the start of the year $L_0$ are first defined. The first value $A_0$ is the angular distance (in radians) between the sun's perigee (its closest approach to the earth) and its position at 0 hr on Jan 0. The second value $L_0$ is the angular distance between the equinox (the point where the sun crosses the equator moving northward) and perigee at 0 hr Jan 0. Both are measured in the plane of the sun's orbit (the ecliptic). Like Sidereal Time above, $A_0$ and $L_0$ vary in a 4-year cycle. From empirical observation:

[4]Data Sources: Naval Alamanac for Computers, 1984, op.cit. (reported to be accurate to 1" of arc).

for years evenly divisible by 4, $A_0=-0.0649321$, $L_0=4.9311077$;

for years with remainder 1, $A_0=-0.0521869$, $L_0=4.9313992$;

for years with remainder 2, $A_0=-0.0566525$, $L_0=4.9316983$;

for years with remainder 3, $A_0=-0.0611183$, $L_0=4.9319977$.

The Mean Anomoly (i.e., the distance between perigee and current position) increases by slightly less than 1° per day (360° in 365¼ days). For time T, the current Mean Anomoly is $$A=A_0+0.017202T \quad (4)$$

Using the value of A from equation (4), the current Solar Longitude, its distance from the equinox measured in the plane of ecliptic, is $$L=L_0+A+0.033458 \sin(A)+0.0003491 \sin(2A) \quad (5)$$

L must be less than 2pi, and it may thus be expressed in modulus 2pi.

Using the value of L obtained in equation (5), the sun's declination $d_s$, i.e. its distance north or south of the equator, is calculated from the equation:

$$\sin(d_s)=0.39787 \sin(L) \quad (6)$$

and it right ascension R, i.e. its angular distance from the equinox measured in the plane of the equator, is calculated from the equation $$\tan(R_s)=0.91744 \tan(L) \quad (7)$$

A given tangent may be in two different quadrants of the circle. However, since $R_s$ must be in the same quadrant as L, it must be adjusted appropriately.

Combining $R_s$ with the value of S obtained in equation (2), the sun's hour angle H (i.e. its angular distance from the local meridian) measured in the plane of the equator, is $$H_s=S-R_s \quad (8)$$

The sun's position relative to equator and the local meridian is found via equation (8). Given the observer's latitude $L_e$, and the results of equations (6) and (8), the altitude a, i.e. the sun's angular distance from the horizon, may be calculated from the equation:

$$\sin(a)=\sin(L_e)\sin(d_s)+\cos(L_e)\cos(d_s)\cos(H_s) \quad (9)$$

The calculated altitude a may then be corrected for refraction as in section V below.

If the sun is determined to be far below the horizon, for example more than 45° below, it will provide no light, even if its position is corrected. In that case, all further calculations as to solar light can be omitted (except in some embodiments for the final corrections in section IX below) and sunlight can be set equal to the stellar baseline $E_b$ from equation (1).

IV. Lunar position. As was the case for determining solar position, two initial positions may be provided to determine lunar position. These parameters are $R_0$, the initial right ascension, and $p_0$. Since lunar positions do not repeat at convenient intervals, simple tabular values for these parameters are generally not available.

The moon is subject to numerous variations in its motion. Most of these variations are too small to be of significance for purposes of the invention, but a preferred embodiment of the invention may take into account the variation in the plane of its orbit.

The sun's orbital plane is tilted at about $23\frac{1}{2}°$ to the equator; the moon's average tilt is the same, but it varies several degrees in either direction in an $18\frac{1}{2}$ year cycle. Another initial parameter no is thus provided to characterize the tilt position in this cycle at the start of the year.

Values for the initial parameters are obtained based on the observation that the moon's position at the end of one year is identical with its position at the start of the next year. If D is the number of days in the year just ended[5],

[5]27.32166 days is the length of the sidereal (fixed star-to-fixed star) month. 27.21222 days is the length of the Draconic (node-to-node) month. 0.4102 is the sine of the average lunar declination. 0.22997 is 2pi/27.32166. Data Sources: *Explanatory Supplement to the Astronomical Ephemeris and the American Ephemeris and Nautical Almanac*, London: HMSO 1961 (for the values of the constants); *American Empheris* (for initial positions).

new $N_0$=old $N_0$+D new $p_0$=(old $P_0$+D) mod 27.21222 new $R_0$=(old $R_0$+0.22997*D) mod 2pi

Thus, $n_0$ decreases by 365 (or 366) for each new year; the function sin [4pi (T+$p_0$)/27.21222] in equation (12) below, evaluated at T=365 (or 366), can thus be solved for a new value of $p_0$ at T=0. Similarly, equation (12) itself can yield a new value for $R_0$.

For 1986, $R_0$=2.56517, $p_0$=8.54425, $n_0$=2693.

Given $n_0$, the current orbital tilt which equals the maximum possible declination, is $$d_{max}=0.4102-0.08971 \cos [2pi(T+n_0)/6798] \quad (10)$$

where T is the time as found in step I, above.

The current lunar declination is $$d_m=d_{max} \sin (2pi\ T/27.32166). \quad (11)$$

The right ascension may be calculated as:

$$R_m=R_0+0.22997(T+0.0133 \sin [4pi(T+p_0)/27.21222]). \quad (12)$$

The moon's hour angle $H_m$ and altitude a may be found as in equations (8) and (9) above, using $R_m$ and $d_m$ in place of $R_s$ and $d_s$. The altitude a, assuming the moon not to be more than 45° below the horizon, may then be corrected for refraction and parallax as in section V, below.

To obtain the phase of the moon, the angle of elongation e (i.e., the angle between the positions of the sun and the moon) may be calculated from the following equation:

$$\cos (e)=\sin (d_s) \sin (d_m)+\cos (d_s) \cos (d_m) \cos (R_s-R_m). \quad (13)$$

V. Correcting the Body's Position. In passing through the atmosphere, light rays are refracted (bent) as they pass through increasingly dense air. This makes the position appear to be slightly different from its true position, particularly when the body is near the horizon. To correct for refraction, the zenith angle z (i.e. the angle between the body's position and the point directly overhead) is first calculated as follows[6]:

[6]Data Sources: *Almanac for Computers*, 1984, op.cit.; Values for standard temperature and pressure from *Handbook of Physics and Chemistry*.

$$z=pi/2-a_0 \quad (14)$$

where $a_0$ is the original altitude calculated in equation (9), above.

Then a variable y is defined such that $$\sin (y)=0.9986047 \sin (0.9967614z) \quad (15)$$

The angle of refraction r, assuming a standard temperature and pressure atmosphere, may be calculataed as:

$$r=0.0010342[3.4302889(z-y)-0.01115929z] \quad (16)$$

The positions of the bodies are then calculated on the assumption that the observer is on the line joining the centers of the earth and the observed body. However, in general this is not true, and a parallax angle must therefore to be considered. In the case of the sun, the difference is insubstantial in terms of the invention and the parallax angle $X_2$ is set as 0. For the moon, the parallax angle $X_m$ may be calculated as:

$$\sin (X_m)=0.0165899 \cos (a) \quad (17)$$

The corrected altitude is thus $$a=a_0+r-X \quad (18)$$

VI. Light Reaching the Planet. Sunlight varies with the square of the distance between the earth and the sun. Using the results of equation (4) above[7],

[7]Data Sources: *Recommended Practice* . . . , supra, f.n. 2, op.cit., slightly modified according to the *Naval Alamanac for Computers*, 1984 op.cit.

$$E_{xt}=127.5\ [1.+0.034 \cos (A)] \quad (19)$$

The moon will treated like a second sun, but its maximum light will considered to be constant.

$$E_{xt}=127.5 \quad (20)$$

VII. Air mass. When the body is directly overhead, its light is considered to pass through one unit of air. In other positions, it must pass through more air. When the body is not near the horizon, one approximation for the air mass is $m_a=1/\sin (a)$, where a is the altitude as found in (18). However, this goes to infinity as the sun approaches the horizon. A preferred approximation is thus[8]:

[8]Source: Rozenberg, G. V. (1966) *Twilight Study in Atmospheric Optics*, New York, Plenum Press. (Originally issued in Russian by the Soviet Academy of Sciences).

$$m_a=1/[\sin (a)+e^{-11 \sin (a)}] \quad (21)$$

VIII. Calculation of light. The calculation of light is handled, in this embodiment, is three case, depending on whether the body is (a) above, (b) below, or (c) part above and part below the horizon.

(a). Body above horizon: First, the direct light from the body $E_{dh}$ is calculated. For a fully cloudy sky, $E_{dh}$=0. Otherwise, using the values from section I and equations (18), (19) or (20), and (21)[9]:

[9]Source: *Recommended Practice* . . ., op.cit, supra, f.n. 2

$$E_{dh}=E_{xt} \sin (a)e^{[-xma]} \quad (22)$$

Then, to calculate skylight, $$E_{kh}=E_0+c\ \sin^p(a) \quad (23)$$

The total light from the body is thus $$E_{body}=E_{dh}+E_{kh} \quad (24)$$

(b). Body below the horizon: The twilight illumination function may be approximated, on a log scale, as a normal curve stretching from $E_b$ at about 30° below the horizon, and reaching $E_0$ at the horizon shortly before the the curve hits its peak.

The underlying normal curve for the altitude a as found in (18) is[10]:

[10]Brown (1952), supra, f.n.1, op. cit.

$$N(a)=e^{[-25.59\ (sin\ (a)-0.029)^{**2}]} \quad (25)$$

To make the normal curve have a height slightly greater than the twilight spread $E_t$ as determined in section I, it may be converted from log to rectangular scale, and made to start at $E_b$ rather than 0. One way to do this is to multiply by $E_t$, take the exponential of the result, and multiply that by $E_b$. The final form is thus:

$$E_{kh}=E_b e^{[1.017\ E_t N(a)]} \quad (26)$$

With the body below the horizon, the direct light $E_{dh}$ is zero and the total light $E_{body}$ is equal to $E_{kh}$.

(c). Body partly above and partly below the horizon: In this case, the body can be regarded as a circle divided into two sections by a horizontal line. The problem is to find the size (i.e. brightness) and the center (i.e. altitude) of each section. Both the sun and moon have an apparent radius r of about ¼°, or pi/720 radians, so there need only be considered cases in which $-r<a<r$. Since the angles considered are extremely small, a=sin (a) can be taken. First, the arc C along the body's circumference taken between the uppermost point of the body and the horizon is determined from the following equation (C must be positive):

$$\cos\ (C)=-a/r \quad (27)$$

The area of the portion above the horizon is thus:

$$P_a=C-\tfrac{1}{2}(\sin\ (2C)) \quad (28)$$

and the proportion of the area above to the total area (i.e. the relative brightness of the section) is $$q_a=p_a/pi \quad (29)$$

The altitude of the portion above the horizon is thus:

$$U_a=\sin\ (a)+[2r\ \sin^3\ (C)/3\ p_a] \quad (30)$$

The light from the risen portion may then be determined as in part (a) above using $U_a$ in place of a, and multiplying the result by $q_a$.

The relative brightness of the area below the horizon is:

$$q_b=1-q_a \quad (31)$$

and its altitude is:

$$U_b=\sin\ (a)-[2r\ \sin^3\ (pi-C)/3(p-p_a)] \quad (32)$$

The light from the part below the horizon is found as in part (b), above using $U_b$ instead of a, and multiplying the result by $q_b$.

The total light may then be expressed as the sum of the light from the portion above and the portion below the horizon.

IX: Final corrections. Above the moon was considered to be a second sun, with the light reaching the earth being equal to the average light from the sun (i.e. $E_{xt}=127.5$) and moonlight was calculated in the same way as sunlight in section VIII, above, obtaining a result hereinafter called $E_{m0}$.

However, moonlight is, of course, much less bright than sunlight, and it varies with the phase of the moon. Further, the calculation in section VIII includes the stellar baseline $E_b$; if the embodiment is calculating both sunlight and moonlight, it will thus be included twice. In that case, $E_b$ should be subtracted from moonlight, $$E_{m1}=E_{m0}-E_b \quad (33)$$

Assuming that there is any moonlight, it may be reduced to the proper light levels for the full moon follows[11]:

[11]Data Source: 0.000002 from the *Explanatory Supplement* . . . , supra, f.n. 5, op.cit.; 3.286 derived to fit data from the *Explanatory Supplement* . . . , op. cit.

$$E_{m2}=0.000002E_{m1} \quad (34)$$

Correcting for phase using the elongation found in equation (13), above, yields:

$$E_{moon}=E_{m2}(e/pi)^{3.286} \quad (35)$$

Finally, the total light available is $$E_{tot}=E_{sun}+E_{moon} \quad (36)$$

The computer controller 1 (FIG. 1) may be embodied in a wide variety of ways. For example, in one embodiment, two microcomputers may be provided in a parallel processing arrangement so that one does mostly the astronomical calculations of expected light level, while the second compares the results of measured light values from a photosensor and operates a stepping motor. An interface board may be provided to link the two computers (via e.g. RS232 serial ports) with an illuminometer (e.g. a UDT System 360 with cosine-corrected probe), forward and reverse limit switches, and the attenuator stepping motor. Alternatively, a single microprocessor or simple microprocessor computer can function to drive the system, presuming sufficient computing power to take advantage of the feedback mechanism.

Specialized illuminometer circuitry may be provided to be resident in the control board, replacing the need for commercial systems.

The invention provides results which closely approximate naturalistic illumination. For example, FIG. 5 compares the illuminance values achieved with the invention (solid line) with the empirical values presented in Biberman (1966); cited data within Biberman (1966) are from Brown, D. E. (1952), *Natural Illumination Charts,* Report No. 374-1, Bureau of Ships, Dept. of the Navy, Compendium on Nocturnal Illumination (1966).

Figure 11:
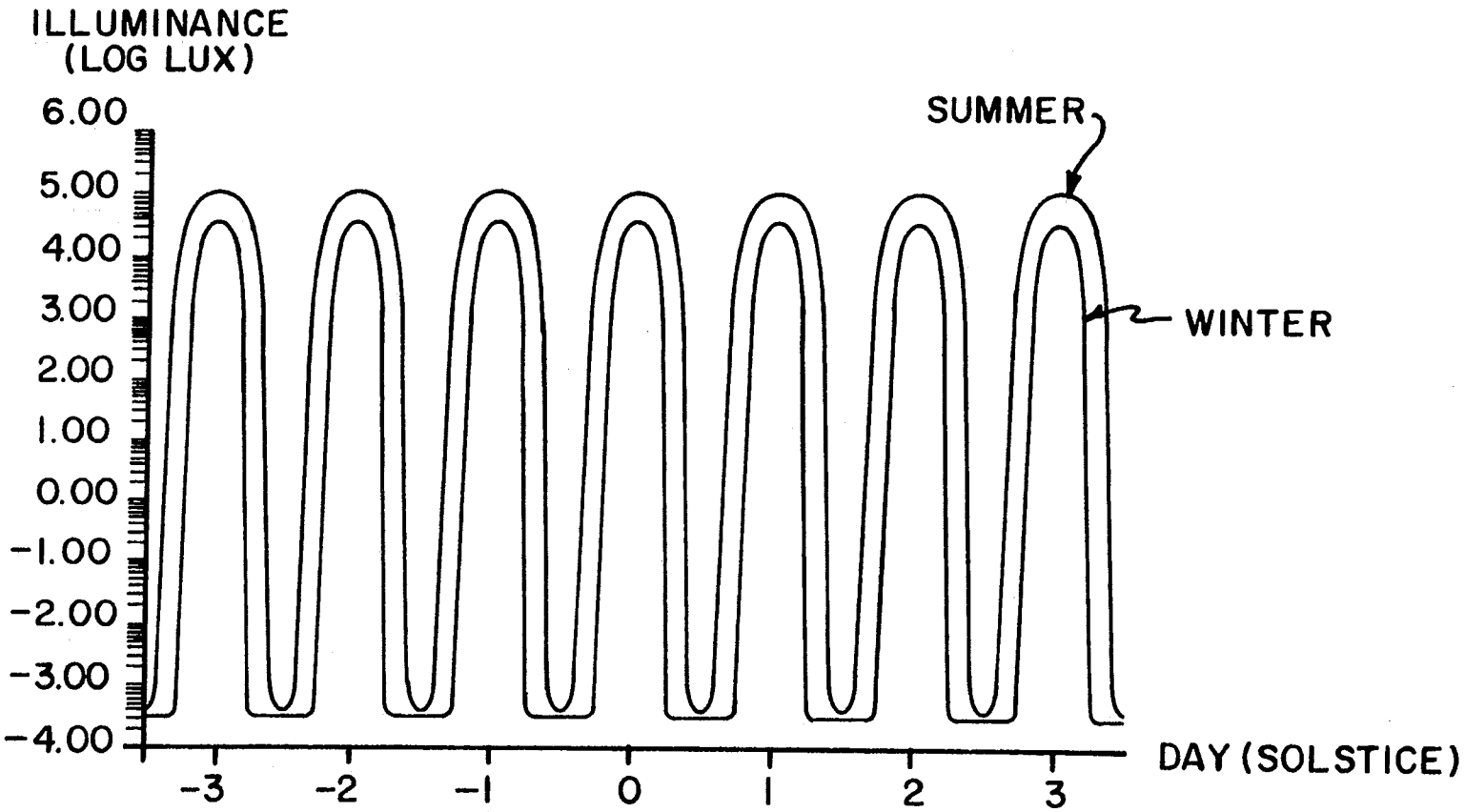
FIG. 11 illustrates algorithm illumination output achieved in one embodiment of the invention for two one-week periods centered on the winter and summer solstices.

As a further example of the successful results of the invention, FIG. 11 illustrates illumination levels output according to one embodiment of the algorithm herein described for two full weeks respectively centered on the summer and winter solstices, for the year 1986, at 45° N latitude, assuming clear skies. In FIG. 11, the expected illumination levels for the week centered on the summer solstice are shown over those for the week centered on the winter solstice. For ease of illustration, moonlight factor outputs are not presented in FIG. 11. The computed graph illustrates the expected results: midsummer light shows higher daily levels throughout the 24-hour cycle, as well as a markedly broader photoperiod; the extended nighttime darkness, at the starlight minimum is seen only in winter; in summer, illumination dips only briefly toward this minimum at midnight. Preferred embodiments of the invention reproduce these cycles up to approximately 3.5 log lux, well above sunrise level (approximately 2.9 log lux).

Transition region information is modeled in the system algorithm between twilight, rising solar disk, and daytime levels, resulting in a more gradual acceleration at the moment of "sun up" (1000 lux region) than has been previously known. Preferred reference algorithms take into account the observation that the twilight transition occurs most rapidly over the equator at the equinoxes.

A graphical representation of the major earth-sun-horizon relations modeled by the driving algorithm is shown in FIGS. 6A–6E. In the drawings of FIGS. 6A–6E, the earth's position is shown within the sun's orbit. A plane is drawn at varying angles that describe the horizon across latitudes. The sun's "movement" is described by an arc above the horizon whose position varies with the seasons. The observer views the entire system from "outside". From this vantage point, the main features of photoperiodic variation become apparent. For example, at the summer solstice on the north pole, the sun is always up. At 60° N, the summer provides an exaggerated photoperiod when contrasted to winter, and the photoperiod at the equinoxes is closely similar across latitudes going further toward the equator. While photoperiod at the equator is virtually invariant across the seasons, the sun's relative position does change, with a resulting small seasonal shift in the time of sunrise and sunset. By moving the plane of the horizon into the earth's surface, and extrapolating the solar arc, one begins to observe the graded twilight function: the twilight transition occurs most rapidly over the equator at the equinoxes.

Figure 7:
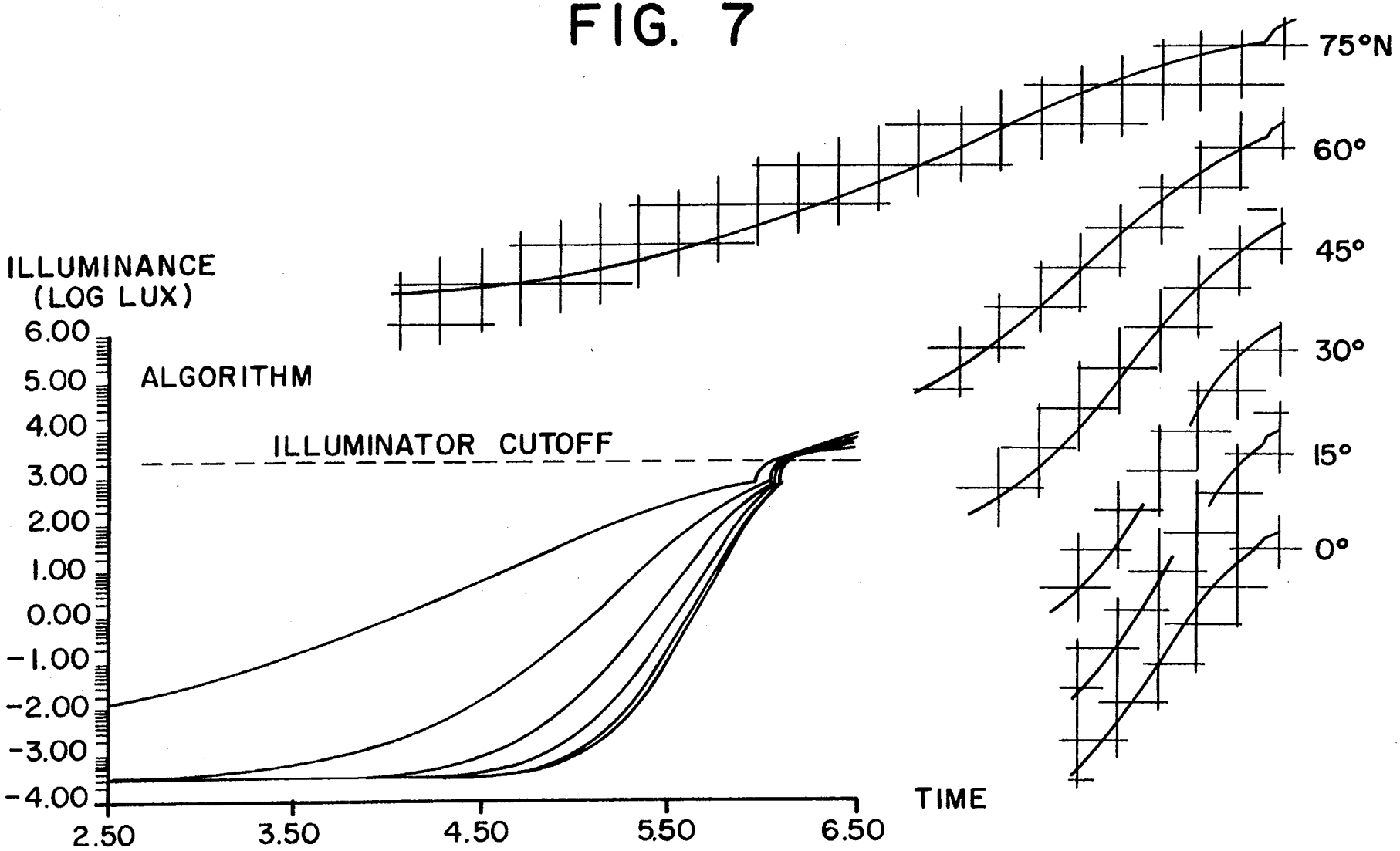
FIG. 7 illustrates illumination curves generated in one embodiment of the invention for dawn-twilight transition across northern latitudes at the fall equinox.

FIG. 7 illustrates a family of illumination curves obtained for the dawn twilight transition across northern latitudes at the fall equinox (lunar component not included). The empirical testing of the invention reported in FIG. 7 was performed in a light-sealed, ventilated chamber designed for animal experimentation. The detector system's analog output was connected to a voltage chart recorder set to cover the approximate 6 log unit range of programmed values from astronomical twilight through sunrise. In FIG. 7, the curves are displaced by a constant on the ordinate, and lined up at the moment of sunrise, which is readily detected by the sudden acceleration in illuminance.

FIG. 7 further shows the corresponding theoretical functions to the empirical results as independently produced by the graphics system of a PDP 11/34 computer, using closely matched time and illuminance scales for ease of comparison. This treatment reveals the progression toward slightly earlier sunrises as a function of latitude. The two curve sets achieve a very close match, with more gradual twilights as the north pole is approached. The empirical curves show a fine grain of discrete illumination steps, resulting from a "search-/pause" strategy provided in one embodiment of a control program. When light transmission through the vanes is viewed, however, these steps would be substantially imperceptible.

Figure 8A:
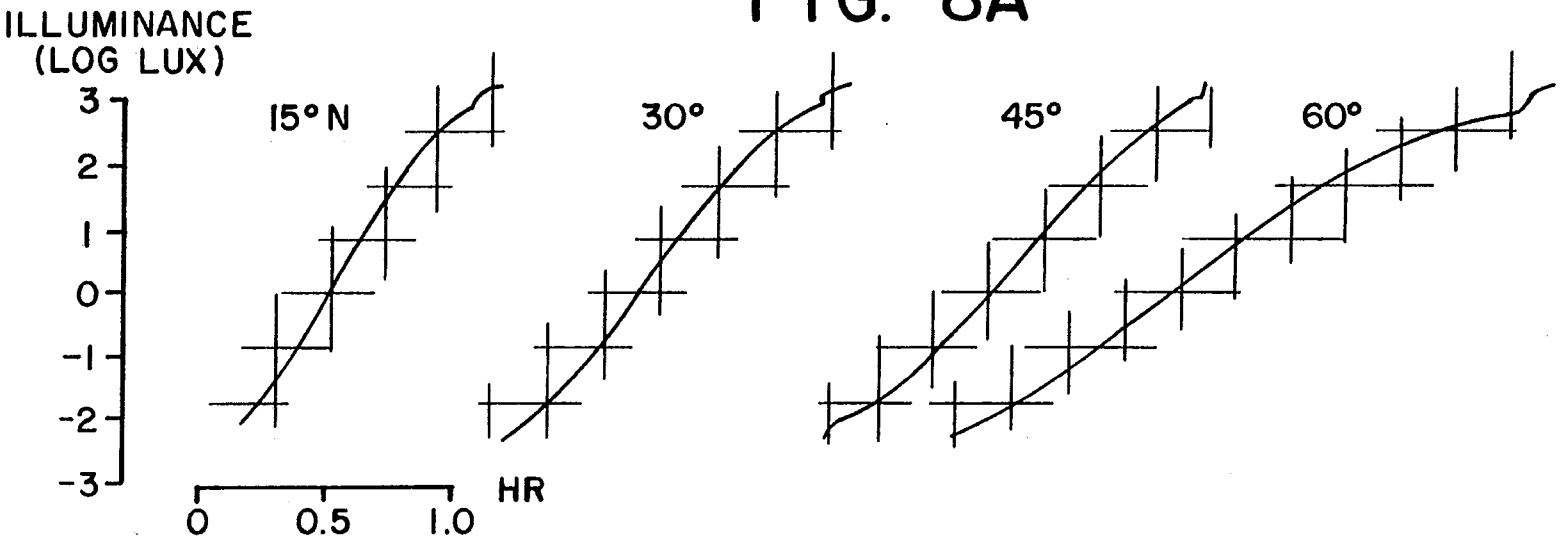
FIGS. 8A–8C illustrate discrete illumination steps in one embodiment of the invention, modeling for the winter solstice, equinox and the summer solstice, respectively.
Figure 8B:
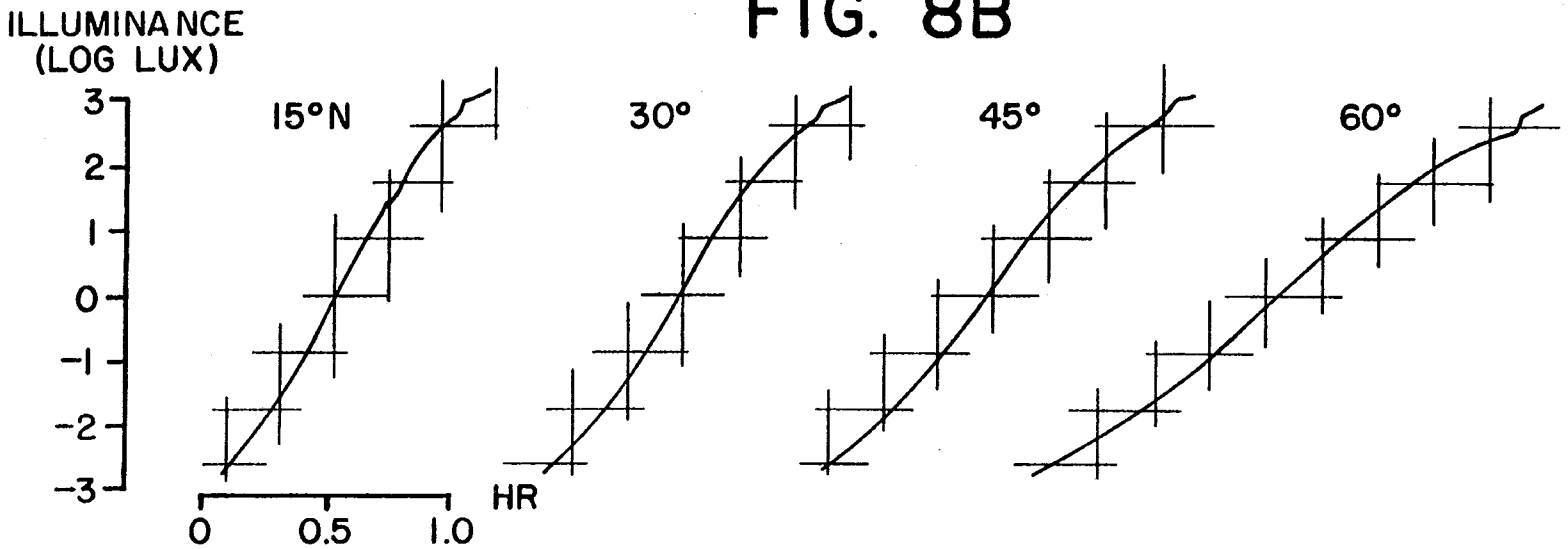
Figure 8C:
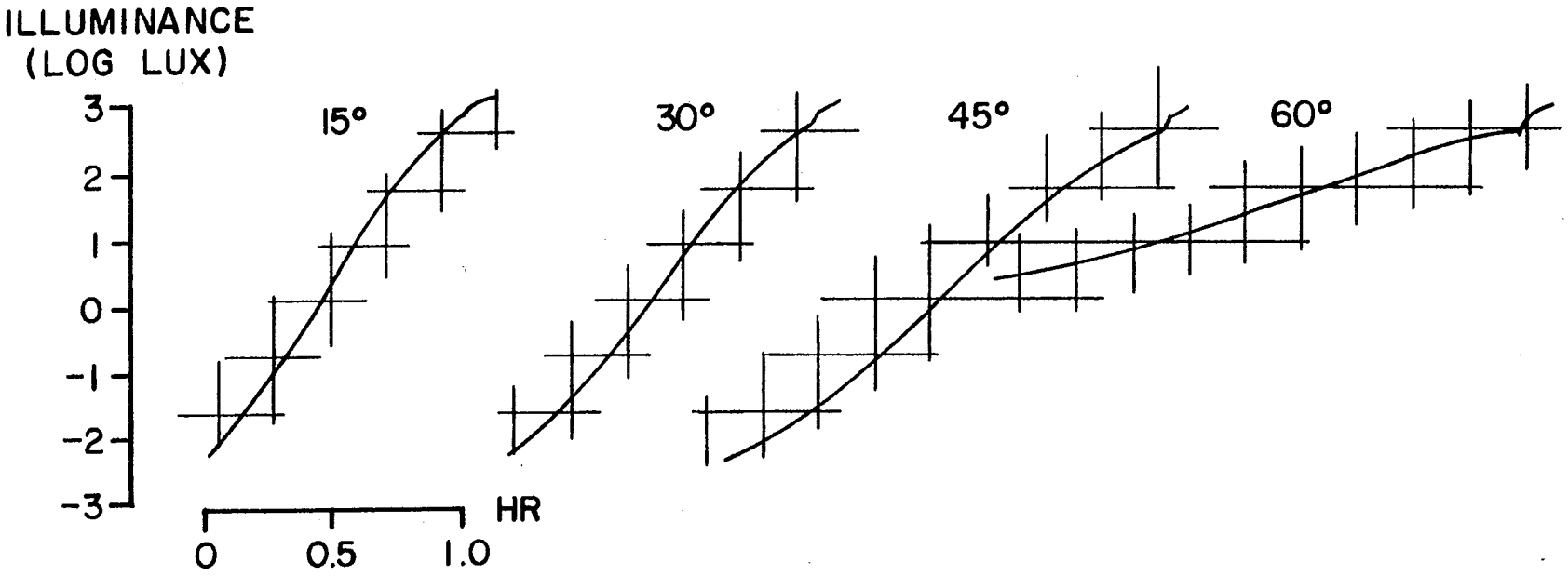

A systematic set of dawn twilight segments further illustrates the function of the system. As shown in FIGS. 8A–8C, seasonal variations in twilight across a mid-range of latitudes may be simulated with the invention. FIG. 8B illustrates equinox variation while FIGS. 8A and 8C illustrate winter solstice and summer solstice variations, respectively. The trends toward slower transitions at the solstices, and with increasing latitude, provide close matches to algorithm predictions.

Figure 9:
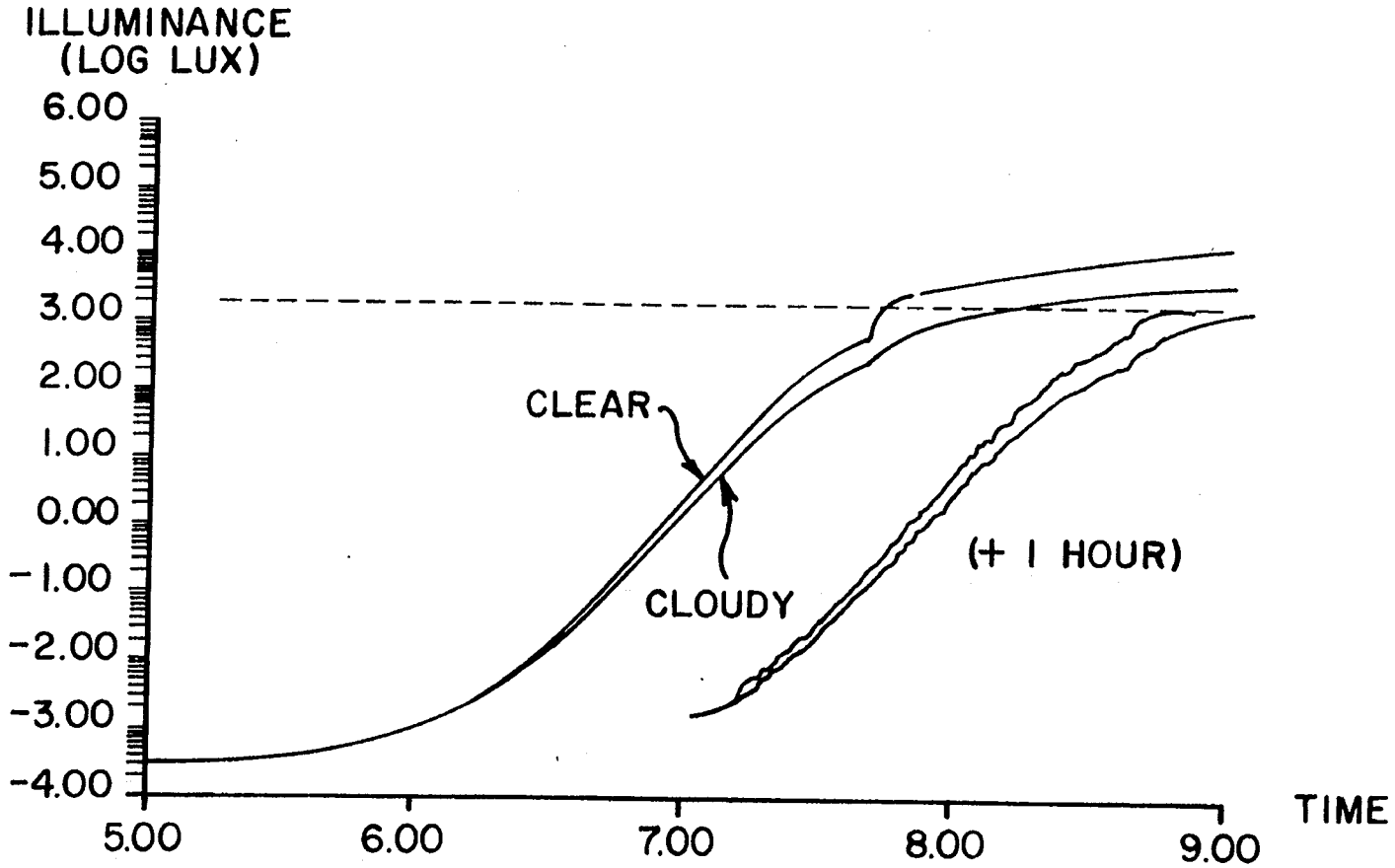
FIG. 9 illustrates the resolution achievable in one embodiment of the invention taking into account cloudy skies.

The invention may be modified by including a relatively subtle cloudiness factor at a constant latitude and day of year (see FIG. 9). At 45° N on the winter solstice, both the algorithm and empirical functions show how bad weather reduces the rate of increment and level of dawn illumination as far down as the range of nautical twilight, depresses the brightness at sunrise by approximately 0.5 log unit, and greatly retards the increase of daytime illumination after sunrise. The moment of sunrise is, of course, unaffected. One example of a daylight cloudiness factor has been described by Treado and Kusuda (1981) and can be likened to a constant atmospheric filter. Preferably, however, the cloudiness factor should more closely represent dynamic weather conditions.

The invention may be further modified to reproduce illumination concomitants of dynamic weather variations through a random-walk model based on empirical outdoor measurements under varying climatic conditions.

A system according to preferred embodiments of the invention will be provided with a comprehensive illumination algorithm allowing the user to specify time of day, day of year, latitude, inclusion or exclusion of simulated moonlight, and progression across days or repeat of a day, thereby triggering a run of indefinite duration. A time compression parameter may also be provided allowing the generation of a full day's cycle at fast speed for calibration runs. This would allow, for example, the vanes of FIG. 3 to be opened and closed at a rapid speed for testing, requiring only several minutes for a full span of operation.

The invention may be preferably embodied to repeat a single day's illumination pattern indefinitely, rather than as a progression across days. So programmed, the invention may thus provide, for example, a method and apparatus for treating Seasonal Affective Disorder by indefinitely repeating a 45° N latitude summer solstice illumination patterns.

Similarly, the invention may be adapted to initiate twilight fades with artificial clock-time triggers (e.g., "dawn" at 6 P.M.) for use, for example, in industrial shift work and jet-lag countermeasurers.

The invention may also be provided as a research tool, by enabling the re-programming of the twilight illumination model to produce a variety of arbitrary waveforms (e.g., sinusoid, log-linear, naturalistic truncated at sunrise) to allow laboratory studies of distinctive features of twilight transitions. The reference generating algorithm may also be modified (e.g., by adjusting constants and/or variables) to take into account both empirical outdoor measurements and theoretical analysis.

A wide variety of embodiments may be provided within the spirit and scope of the invention. For example, finely crafted, super-thin opaque plastic vanes may be provided in the light attenuation mechanisms. Additionally, banks of flourescent lamps, as described above, while practicable, produce often considerable heat during long-term operation, with a very low coefficient of utilization and lumen package. Such lamp banks may be replaced by a set of specialized high-intensity fluorescent lamps driven by electronic ballast at high-frequency resulting in increased transmission, decreased heat, and decreased flicker.

It is also contemplated that color shift may be advantageously modeled within a controlling algorithm according to the invention. The algorithm may then command, for example depending on time, weather and latitude data, that, a red light within a light bank (e.g. within the light box 3 of FIG. 1) be turned on or intensified to mimic naturalistic color shifts. Likewise, embodiments of the invention may provide sophisticated mixings of red, green and blue lights within a light box 3 or within a separate light box to create further naturalistic lighting.

Specially-designed axial fans and ducting may also be added for heat exhaust when the unit is to be used in vulnerable sealed spaces (such as animal testing chambers). A d.c. fluorescent system may be provided, eliminating flicker and EM emissions, and further increasing the illumination maximum.

Shutter operation in some embodiments results in discernible fine steps within the illumination transition curves, uncharacteristic of the outdoors. To eliminate this problem, system software may be programmed to maintain the motor-drive in continuous motion throughout a fade, and if an overshoot occurs relative to algorithm specifications, to decelerate the motor but not stop it until the match is achieved. A chart recording device may be provided, for example, for recording actual illuminance versus time curves for monitoring system performance.

The precision gear-train used to drive the vanes in the embodiment of FIG. 2, while highly accurate and effective may be replaced by a sprocket-and-chain train drive.

The invention may be thus embodied in a wide variety of applications. In a laboratory model, the invention may include a light box and an attenuator of the type illustrated in FIG. 2 fixed through a transparent opening about an otherwise opaque tank. The light sensor may be provided within the tank and the controller either within or without the tank.

Where it is desired to illuminate an entire room, a large bank of lights, or preferably a small ultra-bright metal halide lamp using diffusing optics, may be provided with an electronic dimming or attenuation function and the feedback sensor positioned appropriately within the area of illuminance.

Figure 12A:
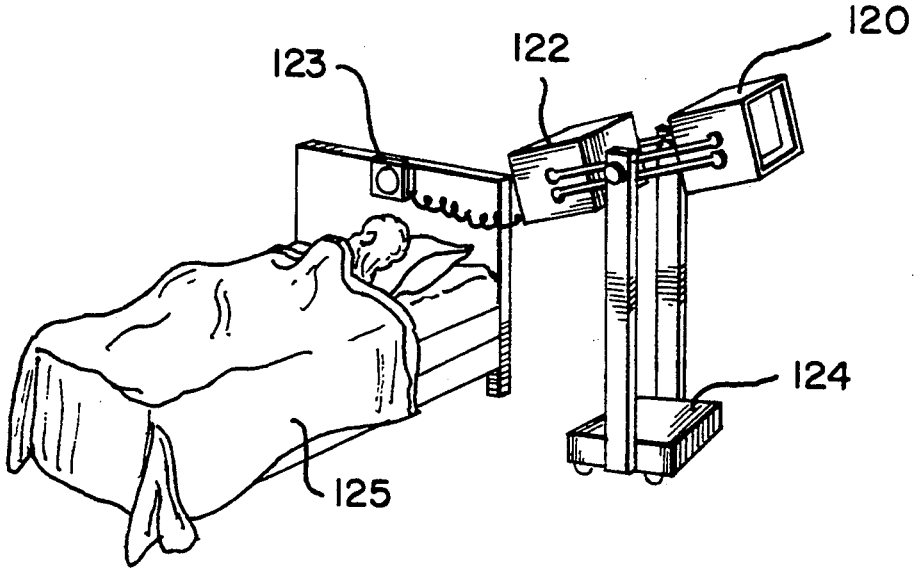
FIGS. 12A and 12B illustrate a personal or home embodiment of the invention.
Figure 12B:
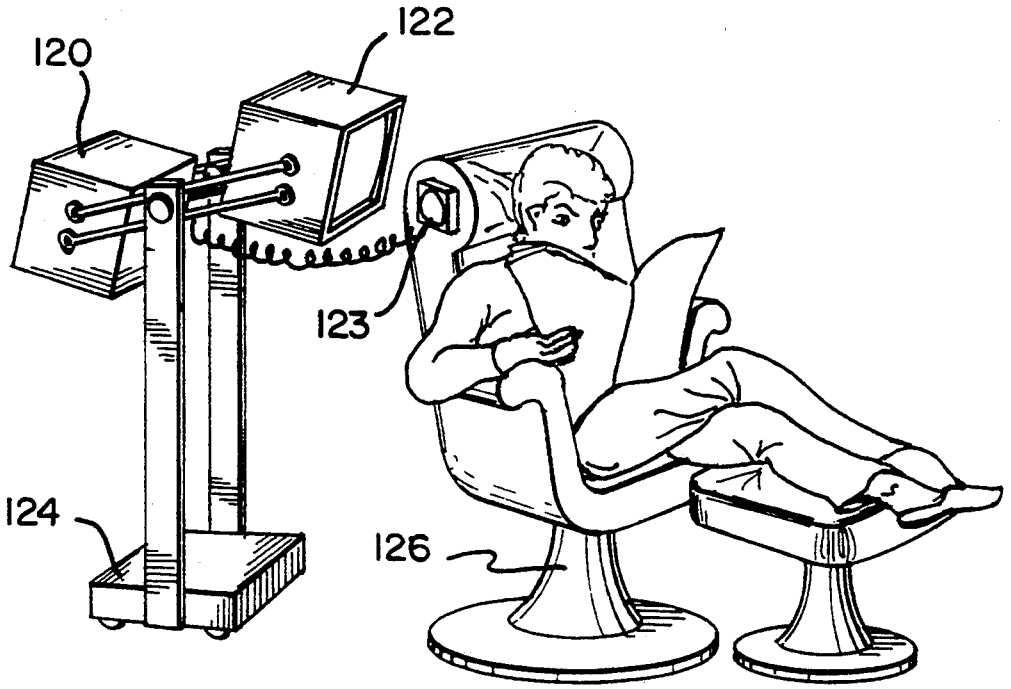

A personal or home embodiment, an example of which is illustrated in the drawings of FIGS. 12A and 12B, may likewise be easily fashioned wherein a photosensor 123 is secured to a position within the general area to be illuminated (e.g. a bed 125 or chair 126) and the controller 120 and the light source/attenuator 120 may be provided on a transportable frame 124. A wide variety of implementations may be thus provided within the spirit of the invention.

Other embodiments may also be provided which eliminate the feedback mechanism of the invention. In such embodiments, knowledge of absolute illumination level and moment-to-moment correction (i.e., matching output to algorithm specifications) will be lost. However, such a system will provide a roughly proportional signal sufficient for certain applications such as esthetic interior lighting.

Thus, although the invention has been described in great detail herein, it should be understood that the invention is not limited to the embodiments herein described, but should be interpreted only in accordance with the claims which follow.

We claim:

1. A naturalistic illumination system for a space for producing a changing total illumination level in the space corresponding to a predetermined portion of a day-night light cycle to adjust the circadian rhythm of a subject in the space comprising light source means;

control means for controlling the amount of light produced by said light source means to be received by the subject in the space;

photosensitive means for measuring the current level of light produced by said light source means;

feedback means for providing data of light measurement from said photosensitive means to said control means; and reference means for providing on a continuously changing basis for a predetermined time period changing data for said selected predetermined time period of an estimated momentary light level data which is continuously changing corresponding to repeatedly calculated momentary solar and lunar altitude and light levels for a particular latitude based on empirical constants and time and continuously advancing said changing data with respect to a given time reference of said selected predetermined time period, said reference means also providing the sum of said solar and lunar light levels, and providing the sum thereof to said control means as said continuously changing estimated momentary light level;

said control means repeatedly determining the difference between said estimated momentary light level and said current level of light and, if there is a difference therebetween, adjusting the amount of light produced by said light source means such that new current level of light will be produced which will substantially equal said estimated momentary level of light.

2. A naturalistic illumination system, as recited in claim 1, wherein said reference generating means additionally calculates momentary lunar altitude and light levels, sums said solar and lunar light levels and provides the sum thereof to said control means as said estimated momentary light level, said reference generating means providing estimates of momentary light levels across a 24-hour day, including twilight transition periods, the light emitted during said twilight transition periods closely mimicking corresponding natural twilight illumination.

3. A naturalistic illumination system, as recited in claim 1, wherein said reference generating means estimates the momentary proportions of a light emitting body being above versus being below the horizon and calculates light emitted from said body as a function of said proportion.

4. A naturalistic illumination system, as recited in claim 2, wherein said estimated lunar light levels are calculated as a function of an estimated phase of the moon.

5. A naturalistic illumination system, as recited in claim 1, wherein said estimated momentary light level is calculated as a function of atmospheric conditions.

6. A naturalistic illumination system, as recited in claim 1, further comprising light attentuation means associated with said light source, said light source emitting a substantially constant amount of light, said control means adjusting said light attentuation means for controlling the amount of light reaching said photosensitive means.

7. A naturalistic illumination system, as recited in claim 1, wherein said reference generating means maintains a clock for calculating estimated momentary light levels.

8. A naturalistic illumination system, as recited in claim 3, wherein said reference generating means maintains a clock for calculating estimated momentary light levels.

9. A naturalistic illumination system, as recited in claim 2, wherein said date is incremented by one at the end of each 24-hour period.

10. A naturalistic illumination system, as recited in claim 8, wherein said reference generating means provides estimates of momentary light levels for substantially all geographic latitudes.

11. A naturalistic illumination system, as recited in claim 1 further comprising a movable frame said light source and said control means being located on said frame, said photosensitive means being positionable within an area to be illuminated.

12. A process for naturalistically illuminating a space with a continuously changing total natural illumination level corresponding to a predetermined portion of a day-night light cycle to adjust the circadian rhythm of a subject in the space, comprising the steps of repeatedly:

(a) measuring in the space the current level of light produced by an artificial light source means for receipt by the subject in the space whose light output can be controllably adjusted;

(b) providing the current light level measured in step (a) as feedback data to a control means;

(c) calculating an estimated natural light level changing over a selected predetermined portion of the day-night light cycle for a particular latitude on the surface of the earth by calculating momentary solar and lunar altitude and light levels based on empirical constants and date and time data with the time data and the light level corresponding thereto being continuously incremented with respect to a given time reference and summing said solar and lunar light levels; and (d) determining the difference between said estimated momentary light level and said current level of light and, if there is a difference therebetween, adjusting the amount of light produced by said light source means such that a new current level of light will be produced which will substantially equal said estimated momentary level of light.

13. The process according to claim 12, wherein said process is repeated for at least two consecutive 24-hour periods, the estimated light values for which are determined as a function of the same date.

14. A naturalistic illumination system for a space for producing a changing total illumination level in the space corresponding to a selected predetermined portion of a day-night light cycle to adjust the circadian rhythm cycle of a subject in the space comprising:

light source means;

control means for continuously controlling the amount of light produced by from said light source means for receipt by the subject in the space to be substantially equal to a continuously varying estimated light level; and reference generating means adapted to repeatedly and continuously (a) calculate over the predetermined portion of 24-hour day-night light cycle an estimated momentary light level for a selected given location on the surface of the earth wherein said reference generating means calculated momentary solar and lunar altitude and light levels based on latitude, date and time data and empirical constants with the time data and the light levels corresponding thereto being continuously updated relative to a changing reference time, (b) sum said solar and lunar light levels, and (c) provide the sum thereof to said control means as said estimated natural momentary light level for determining the amount of light to be produced by said light source means, the light level produced by said light source means varying over the selected predetermined portion of the 24-hour period updated to said estimated momentary light level and spanning approximating twilight transition light levels.

15. A naturalistic illumination system, as recited in claim 14, wherein said reference generating means estimates the momentary proportions of a light emitting body being above versus being below the horizon and calculates light emitted from said body as a function of said proportion.

16. A naturalistic illumination system, as recited in claim 15, wherein said estimated lunar light levels are calculated as a function of the estimated phase of the moon.

17. A naturalistic illumination system, as recited in claim 16, wherein said estimated momentary light level is calculated as a function of atmospheric conditions.

18. The process according to claim 12, wherein the process is repeated periodically during a 24-hour period with said time data incrementing according to 24-hour clock time.

19. The process according to claim 12, wherein said process is repeated for a period such that said time data varies by more than 24-hours and said date data is incremented by one at the end of a 24-hour period.

20. The apparatus according to claim 1, further comprising input means for supplying latitude, date and time data to said reference means.

21. The apparatus according to claim 14, further comprising input means for supplying latitude, date and time data to said reference generating means.

22. A naturalistic illumination system for a subject, comprising: a source for producing light, means to control the total amount of light to be received by the subject, means for measuring the actual level of light produced from said source, means for producing a calculated light level value corresponding to the altitude of a heavenly body and light levels for a selected earth related geographical location which value varies corresponding to the time of day at said location, said control means being responsive to the difference between said calculated light level value and said measured light level value to cause said source to produce light at said calculated light level value which is to be the total amount of light received by the subject.

23. A process according to any of claims 12, 13, 18 or 19 wherein step (c) further comprises the steps of calculating momentary lunar altitude and light levels and summing said solar and lunar light levels to calculate the estimated momentary light level.

* * * * *